United States Patent [19]

Azcarate

[11] 4,076,250

[45] Feb. 28, 1978

[54] BOARD GAME APPARATUS

[76] Inventor: Emilio Azcarate, Oviedo 18-16, Torrimar, Guaynabo, P.R. 00657

[21] Appl. No.: 743,849

[22] Filed: Nov. 22, 1976

[51] Int. Cl.[2] ..... A63F 3/00

[52] U.S. Cl. ..... 273/251

[58] Field of Search ..... 273/134

[56] References Cited

U.S. PATENT DOCUMENTS 3,990,707 11/1976 Terilli ..... 273/134 AT X

FOREIGN PATENT DOCUMENTS 709,543 5/1954 United Kingdom ..... 273/134 AT

*Primary Examiner*—Delbert B. Lowe
*Attorney, Agent, or Firm*—Jay M. Cantor

[57] ABSTRACT

A board game for two or more players simulating convict retrieval in the wild west. A game board is provided simulating a first town with streets and buildings with entrances with an "out of town" street surrounding at least a portion of the first town, the "out of town" street starting at a second town. The streets are laid out with rectangular adjacent areas for movement thereon of game pieces in accordance with numbers provided by a throw of dice. Discs with predetermined symbols or no symbol are placed in each building with symbol face down for use by a player entering the building with his game piece according to the symbol on the disc. The object of the game is to enter a building in the first town having a disc with a first predetermined symbol, then enter a building with a second predetermined symbol, and then move the game piece to the second town without running into any impediments as provided by the game rules, the first player to return to the second town being the winner.

4 Claims, 6 Drawing Figures

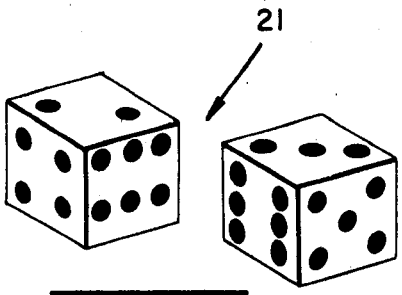
Fig. 2
Fig. 3
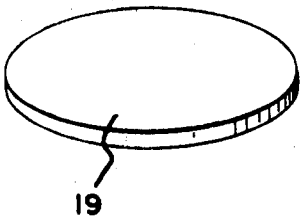
Fig. 4
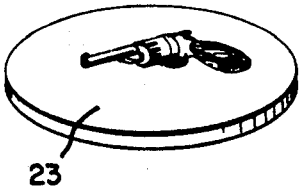
Fig. 5
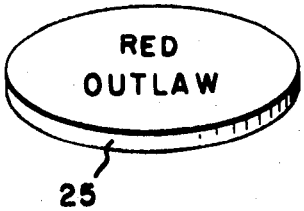
Fig. 6
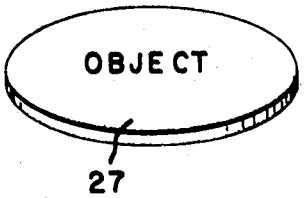

BOARD GAME APPARATUS

This invention relates to improvements in board games and, more specifically, to a board game simulating conditions of the wild west.

The present invention provides a board game comprising a board of rectangular shape having a first path around its perimeter formed of block-shaped areas, the path being marked on both sides thereof by a barrier except for certain ingress regions which lead into second paths within a first town formed of block-shaped areas marked differently from the areas in the first block. The region within said first path and including said second paths forms a first town, this region including buildings with entrances facing onto one area of said second paths. The first and second paths each have one end terminating at a second town outside of said region. Each player has a unique game piece movable from area to area in accordance with a throw of dice. Discs with predetermined symbols or no symbol are placed in each building with symbol face down for use by a player entering the building with his game piece according to the symbol on the disc. The object of the game is to enter a building in the first town having a disc with a first predetermined symbol, then enter a building with a second predetermined symbol and then proceed to the second town without running into any inpediments as provided by the game rules, the first player to return to the second town being the winner.

The game which has been selected to illustrate the invention by way of example is hereinafter described with reference to the accompanying drawings, wherein:

FIG. 2 is a perspective view of dice which are used in accordance with the present invention;

FIG. 3 is a perspective view of a blank disc which is used in accordance with the present invention;

FIG. 4 is a perspective view of a disc with a gun which is used in accordance with the present invention;

FIG. 5 is a perspective view of a disc symbolizing an outlaw which is used in accordance with the present invention; and FIG. 6 is a perspective view of a disc symbolizing the ultimate object to be captured and returned to the hometown.

Figure 1:
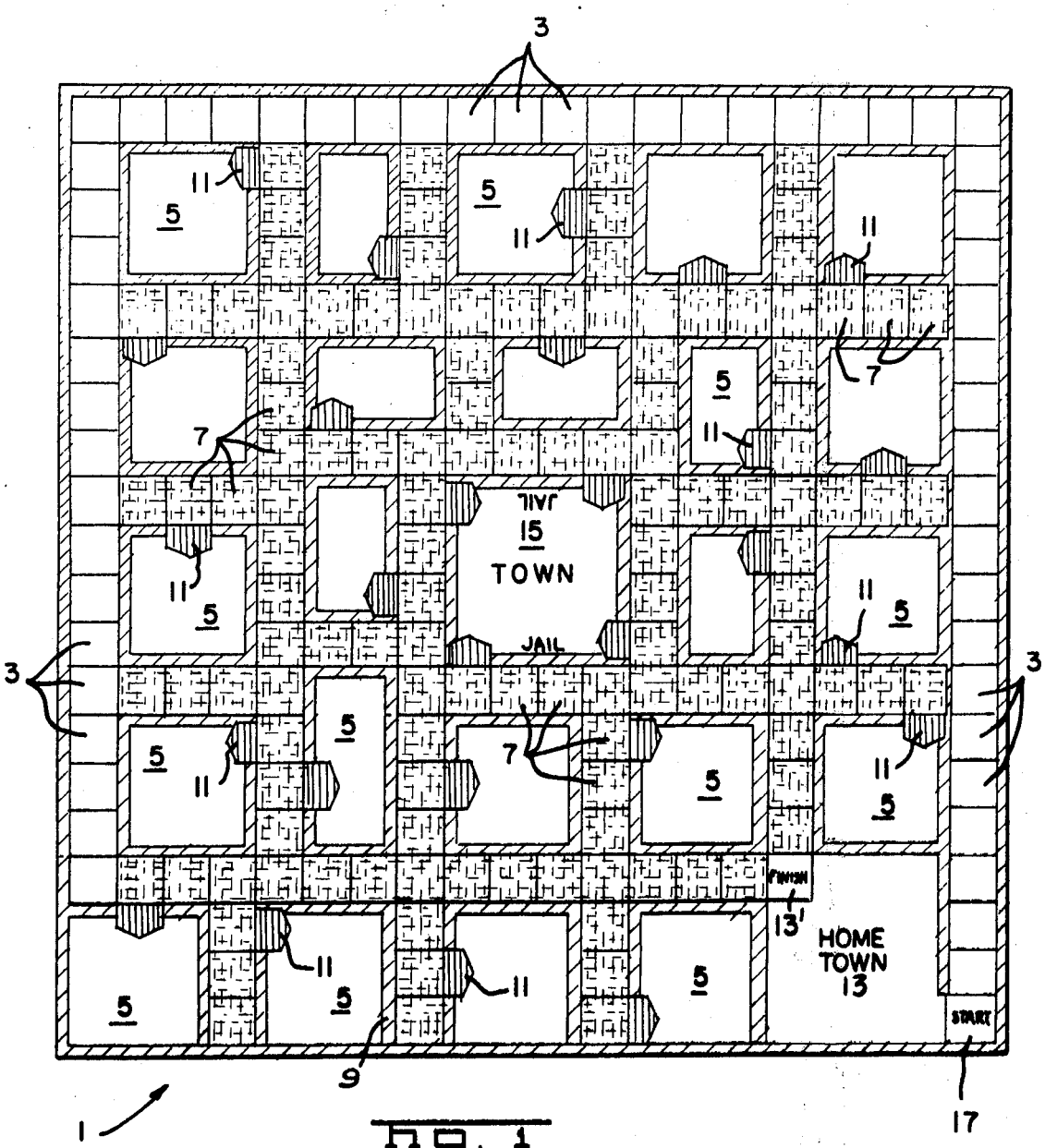
FIG. 1 is a perspective view of a game board in accordance with the present invention.

Referring now to FIG. 1, there is shown the game board 1 in the form of a square including a first path composed of empty squares 3 which surround a first town of buildings 5, regions 7 shown cross hatched and barrier regions 9 separating the buildings 5 from the path regions 3 and 7. The only entrances and exits from buildings 5 are to areas 7 via the regions 11. In addition, the first town includes a jail 15 at the center with regions 11 for exit and a finish area 13. The game board also includes a second town 13 from which a "START" area 17 is positioned at the beginning of the first path. The game appurtenances include a unique game piece for each player which traverses the region along consecutive areas 3 and 7 in accordance with a roll of dice 21 as shown in FIG. 2. Prior to the commencement of play, discs which include blanks 19 (FIG. 3) guns 23 (FIG. 4), outlaws 25 (FIG. 5) and ultimate object 27 (FIG. 6) are shuffled face down and one disc is placed in each building 5 not including the jail 15.

The object of the game is to find ultimate object 27 and bring it back to Home Town 13 and collect the reward. In order to capture object 27, the player must first find a gun 23.

A minimum of 2 and a maximum of 6 persons may play.

Initially, 23 discs or tokens are placed face down on the board 1, shuffled around and placed, one face down inside each of the 23 buildings 5. The complement of discs is as follows:

| Total Number of Players | TOKENS | | | |
|---|---|---|---|---|
| | Blanks (19) | Guns (23) | Red Outlaws (25) | Objects (27) |
| 6 | 10 | 7 | 5 | 1 |
| 5 | 11 | 6 | 5 | 1 |
| 4 | 12 | 5 | 5 | 1 |
| 3 | 13 | 4 | 5 | 1 |
| 2 | 14 | 3 | 5 | 1 |

All players will start from Home Town 13 at start 17. Each player throws the dice and the one with the highest number starts the game.

Each player moves his piece as many spaces as the total number on both dice.

All players but may move forward or backward through any lane may not cross any barrier line 9 and have to finish all the spaces marked on both dice 21 in one direction, except when entering any of the buildings 5 or landing on a space already occupied. In that case, the player may use (a) the total number on both dice, or (b) the number on just one die.

As soon as the player reaches the first town including buildings 5 and areas 7, he will try to enter as many buildings as he can until he finds a disc 23 marked with a gun, then he continues to enter the other houses until he finds the disc 27.

Immediately after the player has found his gun 23 and object 27, he starts his way back to Home Town 13, and as soon as he reaches finish area 13 at Home Town he wins the game.

WHEN ENTERING A BUILDING

A. If the player finds a blank token 19, he takes it out and puts it aside.

B. If the player finds a token 25, he will take it to the Town Jail and will lose one turn. The token 25 is taken out.

C. If the player finds a gun 23 he will keep it. If he already has a gun, he leaves the gun inside the building.

D. If the player finds object 27, and has previously found his gun, he will take object 27 and start his way back to finish 13' at Home Town. But if he does not have a gun, he must leave object 27 inside the house.

LANDING ON A SPACE ALREADY OCCUPIED BY ANOTHER PLAYER

A. If the player is traveling through the outer lane composed of areas 3, he may jump to the next empty space available.

B. If traveling through any lane composed of areas 7, and neither of the two players has found his gun, the player who has landed on the occupied space may jump to the next available space.

C. If traveling through any lane inside the first town and one of the two players has found his gun and the other has not, the one without a gun must go back to Home Town 13.

D. If traveling through any lane inside the first town and both players have found their guns, they will shoot-it-out by throwing the dice once and the one who throws the smaller number has to be moved back to Home Town 13. But if one of the two players is carrying object 27 back to Home Town 13, and he throws the smaller number, he will lose object 27. Then, object 27 must be reshuffled together with all the blank tokens previously found, and all of them will be put face down inside each of the empty houses nearest to Home Town 13.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. A convict retrieval game board for a plurality of players each provided with a unique playing piece and comprising a flat stationary board having defined on a surface thereof a plurality of successively outlined areas defining a plurality of paths for the playing pieces which are individually moved a number of areas along the path in accordance with a throw of the dice, a second plurality of discrete outlined areas representing houses, each having only one simulated entranceway from one of said paths for entry by the unique playing pieces, a starting point for the playing pieces at one end of the path and a finish point at the opposite end of the path, an additional outlined discrete area adjacent the finish point being designated as home town, a disc located in each house area, said disc being blank on at least the one side that is visible, a first plurality of said discs each having a symbol on the opposite side depicting an outlaw, a second plurality of said discs each having a symbol on the opposite side depicting a gun, one of the discs bearing a unique symbol on its opposite side different from the other symbols depicting the main object which is being sought by the players, a further discrete outlined area on said board designated as a jail and having a plurality of simulated entranceways, one from each path of a plurality of paths for entry therein of a player's piece if accompanied by a disc having an outlaw symbol retrieved by a player whose piece had previously entered a house area containing said disc.

2. Game board apparatus as set forth in claim 1 wherein said board is rectangular and said successive discrete areas are disposed along at least three edges of said board.

3. Game board apparatus as set forth in claim 1 wherein said plurality of paths include intersecting paths normal to each other.

4. Game board apparatus as set forth in claim 2 wherein said plurality of paths include intersecting paths normal to each other.

* * * * *